United States Patent [19]

Ang et al.

[11] Patent Number: 4,673,473

[45] Date of Patent: Jun. 16, 1987

[54] MEANS AND METHOD FOR REDUCING CARBON DIOXIDE TO A PRODUCT

[75] Inventors: Peter G. P. Ang; Anthony F. Sammells, both of Naperville, Ill.

[73] Assignee: Peter G. PA Ang, Naperville, Ill.

[21] Appl. No.: 741,780

[22] Filed: Jun. 6, 1985 (Under 37 CFR 1.47)

[51] Int. Cl.[4] ..... C25B 3/00

[52] U.S. Cl. ..... 204/59 R; 204/72; 204/263; 204/265

[58] Field of Search ..... 204/72, 75, 237, 242, 204/252, 263–265, 59 R, 62

[56] References Cited

U.S. PATENT DOCUMENTS

| | | | |
|---|---|---|---|
| 3,220,941 | 11/1965 | Osborne | 204/72 |
| 3,766,027 | 10/1973 | Gregory | 204/72 |
| 3,959,094 | 11/1976 | Steinberg | 204/72 |
| 4,219,392 | 8/1980 | Halmann | 204/72 |
| 4,240,882 | 12/1980 | Ang et al. | 204/72 |
| 4,381,978 | 5/1983 | Gratzel et al. | 204/72 |
| 4,523,981 | 6/1985 | Ang et al. | 204/72 |

FOREIGN PATENT DOCUMENTS

| | | | |
|---|---|---|---|
| 3246070 | 6/1984 | Fed. Rep. of Germany | 204/72 |

*Primary Examiner*—John F. Niebling
*Assistant Examiner*—Terryence Chapman

[57] ABSTRACT

Apparatus for reducing carbon dioxide to the product includes a reduction cell which has a dual porosity cathode, a catholyte chamber having an inlet, a passageway through which passes an electrolyte, a dual porosity cathode separating the passageway from the catholyte chamber, an anolyte chamber has an inlet and an outlet. A porous anode with a hydrophobic barrier separates the passageway from the anolyte chamber. A source provides a d.c. voltage across the cathode and the anode. Water is provided to the inlet of the anolyte chamber, while an electrolyte is provided to the passageway. Carbon dioxide is provided to the inlet of the catholyte chamber so that the carbon dioxide is electrochemically reduced within the dual porosity cathode with the electrolyte and hydrogen ions so as to cause the reduction of the carbon dioxide to a product and to cause oxygen to be emitted from the outlet of the anode chamber. The product is removed from the electrolyte after leaving the electrolytic cell.

56 Claims, 3 Drawing Figures

MEANS AND METHOD FOR REDUCING CARBON DIOXIDE TO A PRODUCT

BACKGROUND OF THE INVENTION

1. Field of the Invention

The present invention relates to electrochemical processes in general and, more particularly, to apparatus and the method for reducing carbon dioxide to provide a product.

2. Summary of the Invention

Apparatus for reducing carbon dioxide to the product includes a reduction cell which has a dual porosity cathode, a catholyte chamber having an inlet, a passageway through which passes an electrolyte, a dual porosity cathode separating the passageway from the catholyte chamber, an anolyte chamber has an inlet and an outlet. A porous anode with a hydrophobic barrier separates the passageway from the anolyte chamber. A source provides a d.c. voltage across the cathode and the anode. Water is provided to the inlet of the anolyte chamber, while an electrolyte is provided to the passageway. Carbon dioxide is provided to the inlet of the catholyte chamber so that the carbon dioxide is electrochemically reduced within the dual porosity cathode with the electrolyte and hydrogen ions so as to cause the reduction of the carbon dioxide to a product and to cause oxygen to be emitted from the outlet of the anode chamber. The product is removed from the electrolyte, present on the cathode side, after leaving the electrolytic cell.

The objects and advantages of the invention will be described more fully hereinafter from a consideration of the detailed description which follows, taken together with the accompanying drawings wherein several embodiments of the invention are illustrated by way of example. It is to be expressly understood, however, that the drawings are for illustration purposes only and are not to be construed as defining the limits of the invention.

DESCRIPTION OF THE INVENTION

The present invention electrochemically reduces carbon dioxide to valuable chemicals such as oxalate, formate, and formaldehyde. With an aqueous electrolyte solution the reduction rate is very slow. Better rates (higher current densities) are achieved using non-aqueous electrolyte systems for $CO_2$ reduction to oxalate. The use of high catalytic surface area porous gas diffusion electrodes will maximize the three phase interface of the carbon dioxide, the catalyst and the electrolyte. This allows very high apparent current densities to be passed through the electrode for the reduction of the carbon dioxide to commercial chemicals at practical rates.

Figure 1:
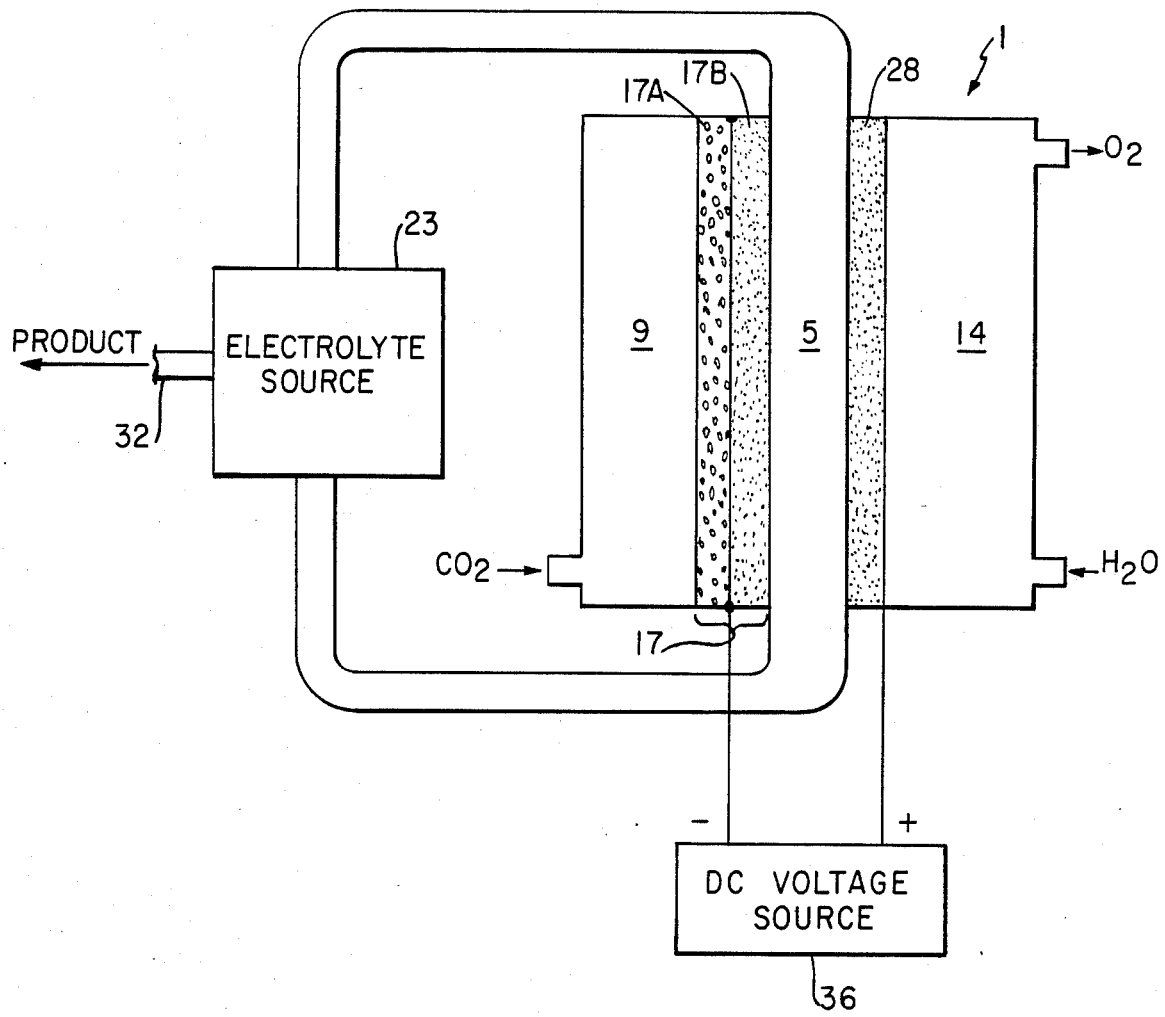
FIG. 1 is a partial schematic and partial cutaway drawing of apparatus for reducing carbon dioxide to a product constructed in accordance with one embodiment of the present invention.

FIG. 1 shows a DSK type cell which consists of a pressure vessel 1 having an electrolyte passageway 5, a carbon dioxide chamber 9, a water/oxygen chamber 14.

A dual porosity cathode 17 has a section 17A having coarse pores, which may be in the neighborhood of 20 to 60 microns in diameter, and a section 17B of fine pores having pore sizes of 2 to 5 microns in diameter. Cathode 17 as noted is made of porous material which may be titanium, stainless steel, nickel, raney nickel, cobalt, carbon, reticulated vitreous carbon and has specific catalysts introduced into the cathode such as lead or gold for formate production, or silicon for oxalate production. Indium phosphide, containing catalytic quantities of cobalt and lead, or mercury can be used in aqueous systems for formate production.

Carbon dioxide is provided to chamber 9 under pressure so there is no need for a hydrophobic barrier. An electrolyte source 23 provides either a non-aqueous or an aqueous electrolyte to passageway 5. A non-aqueous electrolyte for the oxalate production is dimethylformamide with a supporting electrolyte selected from the following: tetrabutylammonium perchlorate, tetrabutylammonium tetrafluoroborate, tetrabutylammonium hexafluorophosphate, tetraethylammonium perchlorate and tetraethylammonium tetrafluoroborate. An aqueous electrolyte may be 1M potassium chloride.

A single porosity anode 28 is adjacent passageway 5 so that there is an interaction within anode 28 resulting in the conversion of $H_2O$ to oxygen which gives up the hydrogen ion for use in the formation of the product within the electrolyte. The electrolyte carries the product out. The product is then separated from the electrolyte and provided via line 32.

A d.c. voltage source 36 has its negative terminal connected to cathode 17 and its positive terminal connected to anode 28 and provides a direct current voltage across cathode 17, the electrolyte in passageway 5 and anode 28 to facilitate the transfer of electrons into the reaction area for the carbon dioxide.

Figure 2:
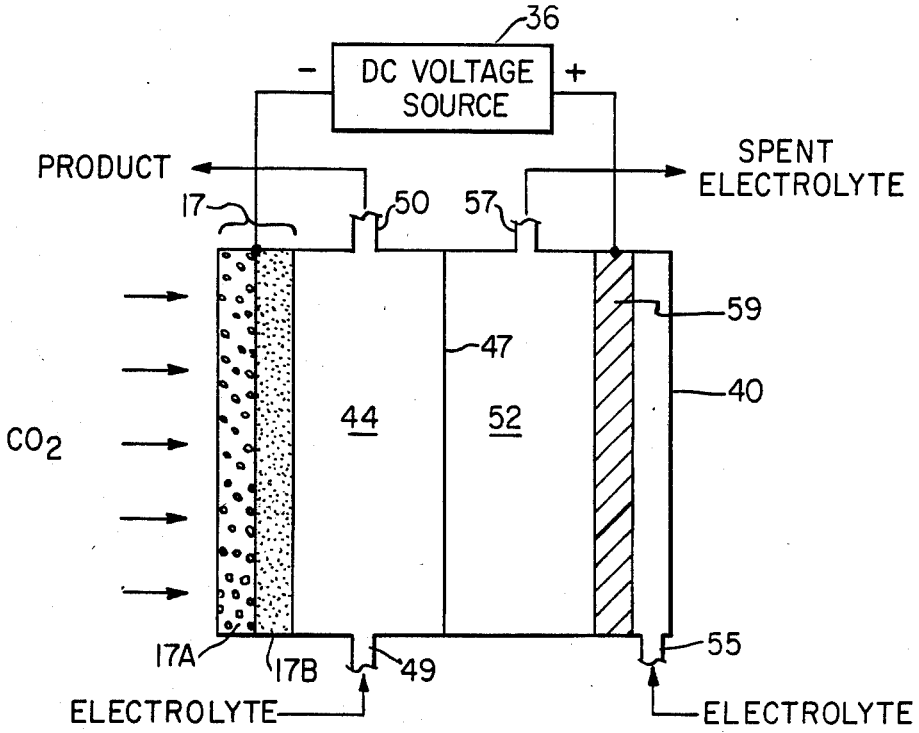
FIGS. 2 and 3 are partial schematic and partial cutaway drawings of apparatus for reducing carbon dioxide to provide a product in accordance with other embodiments of the present invention.

FIG. 2 shows another embodiment of the dual porosity electrode concept. For convenience, those elements that are in FIG. 1 and which appear in FIG. 2, have the same numeric identification. There is shown a cell 40 having a dual porosity cathode 17 as one side with its coarse pore section 17A and its fine pore section 17B. Carbon dioxide is applied to section 17A at a predetermined pressure. There is a catholyte chamber 44 adjacent to cathode 17 the side walls of cell 40 and a separator 47 which has electrolyte provided through an inlet 49 into chamber 44 and a product leaving by an outlet 50 from chamber 44. There is another chamber formed by separator 47 and the side wall of cell 40 having an inlet 55 and an outlet 57 throug which the electrolyte is also provided to. There is within chamber 52 a porous anode 59 so that electrolyte entering inlet 55 passes through anode 59 and after the reaction passes as spent electrolyte from exit 57. The use of porous anode 59 eliminates mass transfer losses allowing cell 40 to operate at a lower voltage. D.C. voltage source 36 has its positive terminal connected to anode 59 and its negative terminal connected to cathode 17 to provide electrons for use in the reaction process.

Figure 3:
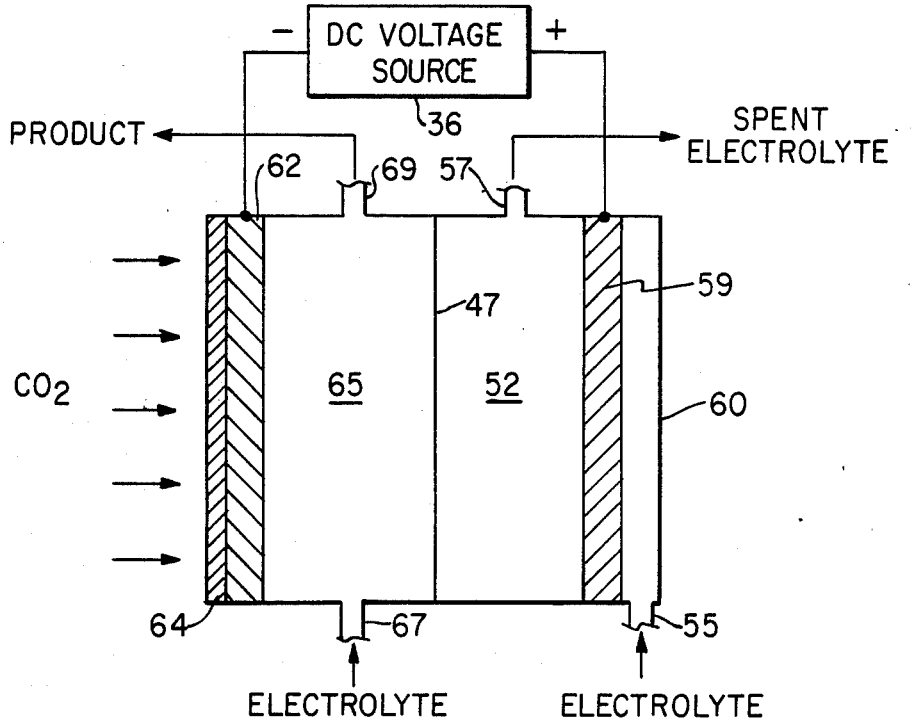

With reference to FIG. 3, there is shown yet another form of the present invention in which there is a vessel 60, one end of the vessel 60 being a single porosity cathode 62 and a hydrophobic barrier 64 through which carbon dioxide gas passes, but not a liquid. The carbon dioxide passes through barrier 64 and through cathode 62 into a chamber 65 having an inlet 67 through which electrolyte enters and an outlet 69 from which a product exits. There is also present separator 47 and there is another chamber 52 which is the same as chamber 52 with its inlet 55 and outlet 57 as shown in FIG. 2. There is porous anode 59, the same as in FIG. 2. It should be noted that the electrolyte to be used in this embodiment is an aqueous electrolyte, such as 1M potassium chloride, which therefore requires the hydrophobic barrier 64.

What is claimed is:

1. Apparatus for reducing carbon dioxide to a product comprising:

a reaction cell means including a catholyte chamber having an inlet, passageway means for having an electrolyte pass through, a dual porosity cathode separating said passageway means from said catholyte chamber and having a catalyst, an anolyte chamber having an inlet and an outlet, and a porous anode with a hydrophobic barrier separating the passageway means from the anolyte chamber, means for providing a dc voltage across the cathode and the anode;

means for providing water to the inlet of said anolyte chamber;

means for providing an electrolyte to the psasageway means;

means for providing carbon dioxide to the inlet of the catholyte chamber so that the carbon dioxide reacts within the dual porosity cathode with the electrolyte and hydrogen which has passed through the anode so as to cause the reduction of the carbon dioxide to a product and to cause oxygen to be emitted from the outlet of the anode chamber, and means for removing the product from the electrolyte.

2. Apparatus as described in claim 1 in which the electrolyte is a non-aqueous electrolyte.

3. Apparatus as described in claim 2 in which the porous material for the dual porosity cathode is selected from a group of porous materials, consisting of titanium, stainless steel, nickel, raney nickel, cobalt, carbon, and reticulated vitreous carbon.

4. Apparatus as described in claim 3 in which the catalyst is selected from a group consisting of lead and gold; and the product is formate.

5. Apparatus as described in claim 3 in which the catalyst is silicone and the product is an oxalate.

6. Apparatus as described in claim 3 in which the non-aqueous electrolyte is dimethylformamide with a supporting electrolyte which is selected from the group consisting of tetrabutylammonium perchlorate, tetrabutylammonium; tetrafluoroborate; tetrabutylammonium hexafluorophosphate; tetraethylammonium perchlorate and tetraethylammonium tetrafluoroborate.

7. Apparatus as described in claim 1 in which the electrolyte is 1M potassium chloride.

8. Apparatus as described in claim 7 in which the porous material for the dual porosity cathode is selected from the group consisting of titanium, stainless steel, nickel, rhaney nickel, cobalt, carbon, and reticulated vitreous carbon.

9. Apparatus as described in claim 8 in which the catalyst is selected from the group consisting of lead and gold, and the product is formate.

10. Apparatus as described in claim 8 in which the catalyst is silicon and the product is an oxalate.

11. Apparatus for reducing carbon dioxide to a product comprising:

a cell including a separator for separating the cell into two sections, a catholyte section and an anolyte section, each section having an inlet and an outlet, a dual porosity cathode having a catalyst and forming one wall of the catholyte section, and a porous anode arranged within the anolyte section in a manner so that an electrolyte entering through the inlet of the anolyte section will pass through the anode and exit through the outlet of the anolyte section;

means for providing an electrolyte to the inlets of both sections of the cell; and means for providing carbon dioxide to the dual porosity cathode at a predetermined pressure;

means for providing a d.c. voltage across the dual porosity cathode and the anode so as to cooperate in the reduction of the carbon dioxide within the dual porosity cathode to the product in the catholyte section.

12. Apparatus as described in claim 11 in which the electrolyte is a non-aqueous electrolyte.

13. Apparatus as described in claim 12 in which the porous material for the dual porosity cathode is selected from the group of porous materials consisting of titanium, stainless steel, nickel, raney nickel, cobalt, carbon, and reticulated vitreous carbon.

14. Apparatus as described in claim 13 in which the catalyst is selected from the group consisting of lead and gold; and the product is formate.

15. Apparatus as described in claim 13 in which the catalyst is silicon and the product is an oxalate.

16. Apparatus as described in claim 13 in which the non-aqueous electrolyte is dimethylformamide with a supporting electrolyte which is selected from the group consisting of: tetrabutylammonium perchlorate; tetrabutylammonium tetrafluoroborate; tetrabutylammonium hexafluorophosphate; tetraethylammonium perchlorate and tetraethylammonium tetrafluoroborate.

17. Apparatus as described in claim 11 in which the electrolyte is 1M potassium chloride.

18. Apparatus as described in claim 17 in which the porous material for the dual porosity cathode is selected from the group consisting of titanium, stainless steel, nickel, raney nickel, cobalt, carbon, and reticulated vitreous carbon.

19. Apparatus as described in claim 18 in which the catalyst is selected from the group consisting of lead and gold, and the product is formate.

20. Apparatus as described in claim 18 in which the catalyst is silicon and the product is an oxalate.

21. Apparatus for reducing carbon dioxide to a product comprising a cell including a separator for separating the cell into two sections, a catholyte section and an anolyte section, each section having an inlet and an outlet a polytetrafluorethylene bonded cathode forming one exterior wall of the catholyte section, and a porous anode arranged within the anolyte section in a manner so that an electrolyte entering through the inlet of the anolyte section will pass through the anode and exit through the outlet of the anolyte section;

means for providing an electrolyte to the inlets of both sections of the cell;

means for providing carbon dioxide to the polytetrafluoroethylene bonded cathode; and means for providing a d.c. voltage across the polytetrafluoroethylene bonded cathode and the anode so as to cooperate in the reduction of the carbon dioxide within the polytetrafluoroethylene bonded cathode to the product in the catholyte section.

22. Apparatus as described in claim 21 in which the electrolyte is a non-aqueous electrolyte.

23. Apparatus as described in claim 22 in which the porous material for the polytetrafluorethylene bonded cathode is selected from the group consisting of titanium, stainless steel, nickel, rhaney nickel, cobalt, carbon, and reticulated vitreous carbon.

24. Apparatus as described in claim 23 in which the catalyst is selected from the group consisting of lead and gold and the product is formate.

25. Apparatus as described in claim 23 in which the catalyst is silicon and the product is an oxalate.

26. Apparatus as described in claim 23 in which the non-aqueous electrolyte is dimethylformamide with a supporting electrolyte with is selected from the group consisting of: tetrabutylammonium perchlorate; tetrabutylammonium tetrafluoroborate; tetrabutylammonium hexafluorophosphate; tetraethylammonium perchlorate and tetraethylammonium tetrafluoroborate.

27. A method for reducing carbon dioxide to a product comprising the steps of:

providing carbon dioxide to a catholyte chamber of a reaction cell, providing water to an anolyte section of the reaction cell, forming a passageway through the reaction cell with a dual porosity cathode between said passageway and said catholyte chamber and with a porous anode between said passageway and said anolyte chamber, providing an electrolyte in a manner so that it passes through said passageway, and providing a direct current voltage across said dual porosity cathode and said anode so as to cause a reduction of the carbon dioxide in cooperation with the electrolyte and hydrogen ions passing through the anode, to a product contained within the electrolyte and to cause oxygen to be emitted from the anolyte chamber.

28. A method as described in claim 27 in which the electrolyte is a non-aqueous electrolyte.

29. A method as described in claim 28 in which the porous material for the dual porosity cathode is selected from the group consisting of titanium, stainless steel, nickel, raney nickel, cobalt, carbon, and reticulated vitreous carbon.

30. A method as described in claim 29 in which the catalyst is selected from the group consisting of lead and gold, and the product is formate.

31. A method as described in claim 29 in which the catalyst is silicon and the product is an oxalate.

32. A method as described in claim 29 in which the non-aqueous electrolyte is dimethylformamide with a supporting electrolyte which is selected from the group consisting of: tetrabutylammonium perchlorate; tetrabutylammonium; tetrafluoroborate; tetrabutylammonium hexafluorophosphate; tetraethylammonium perchlorate and tetraethylammonium tetrafluoroborate.

33. A method as described in claim 27 in which the electrolyte is 1M potassium chloride.

34. A method as described in claim 33 in which the porous material for the dual porosity cathode is selected from the group consisting of titanium, stainless steel, nickel, rhaney nickel, cobalt, carbon, and reticulated vitreous carbon.

35. A method as described in claim 34 in which the catalyst is selected from the group consting of lead and gold, and the product is formate.

36. A method as described in claim 35 in which the catalyst is silicon and the product is an oxalate.

37. A method for reducing carbon to a product comprising the steps of:

providing carbon dioxide to the catholyte chamber of a reduction cell also having an anolyte chamber separated from the catholyte chamber by a separator, providing a dual porosity cathode as an exterior wall of the catholyte chamber, arranging a porous anode within the anolyte chamber so that an electrolyte entering the anolyte chamber will pass through the anode before exiting the anolyte chamber, providing an electrolyte to both chambers, providing carbon dioxide at a predetermined pressure to an exterior surface of the dual porosity cathode, and providing a d.c. voltage across the dual porosity cathode and the anode so as to cooperate in the reduction of the carbon dioxide within the dual porosity cathode and the anode so as to cooperate in the reduction of the carbon dioxide within the dual porosity cathode to the product in the catholyte section.

38. A method as described in claim 37 in which the electrolyte is a non-aqueous electrolyte.

39. A method as described in claim 38 in which the porous material for the dual porosity cathode is selected from the group consisting of titanium, stainless steel, nickel, rhaney nickel, cobalt, carbon, and reticulated vitreous carbon.

40. A method as described in claim 39 in which the catalyst is selected from the group consisting of lead and gold, and the product is formate.

41. A method as described in claim 39 in which the catalyst is silicon and the product is an oxalate.

42. A method as described in claim 39 in which the non-aqueous electrolyte is dimethylformamide with a supporting electrolyte which is selected from the group consisting of: tetrabutylammonium perchlorate; tetrabutylammonium; tetrafluoroborate; tetrabutylammonium hexafluorophosphate; tetraethylammonium perchlorate and tetraethylammonium tetrafluoroborate.

43. A method as described in claim 37 in which the electrolyte is 1M potassium chloride.

44. A method as described in claim 43 in which the porous material for the dual porosity cathode is selected from the group consisting of titanium, stainless steel, nickel, raney nickel, cobalt, carbon, and reticulated vitreous carbon.

45. A method as described in claim 44 in which the catalyst is selected from the group consisting of lead and gold, and the product is formate.

46. A method as described in claim 44 in which the catalyst is silicon and the product is an oxalate.

47. A method for reducing carbon to a product comprising the steps of:

providing carbon dioxide to the catholyte chamber of a reduction cell also having an anolyte chamber separated from the catholyte chamber by a separator, providing a polytetrafluoroethylene bonded cathode as an exterior wall of the catholyte chamber, arranging a porous anode within the anolyte chamber so that an electrolyte entering the anolyte chamber will pass through the anode before exiting the anolyte chamber, providing an electrolyte to both chambers, providing carbon dioxide at a predetermined pressure to an exterior surface of the Teflon bonded cathode, and providing a d.c. voltage across the polytetrafluoroethylene bonded cathode and the anode so as to cooperate in the reduction of the carbon dioxide within the polytetrafluoroethylene bonded cathode and the anode so as to cooperate in the reduction of the carbon dioxide within the dual porosity cathode to the product in the catholyte section.

48. A method as described in claim 47 in which the electrolyte is a non-aqueous electrolyte.

49. A method as described in claim 48 in which the porous material for the polytetrafluoroethylene bonded cathode is selected from the group consisting of titanium, stainless steel, nickel, raney nickel, cobalt, carbon, and reticulated vitreous carbon.

50. A method as described in claim 49 in which the catalyst is selected from the group consisting of lead and gold, and the product is formate.

51. A method as described in claim 49 in which the catalyst is silicon and the product is an oxalate.

52. A method as described in claim 49 in which the non-aqueous electrolyte is dimethylformamide with a supporting electrolyte which is selected from the group consisting of: tetrabutylammonium perchlorate; tetrabutylammonium; tetrafluoroborate; tetrabutylammonium hexafluorophosphate; tetraethylammonium perchlorate and tetraethylammonium tetrafluoroborate.

53. A method as described in claim 47 in which the electrolyte is 1M potassium chloride.

54. A method as described in claim 53 in which the porous material for the polytetrafluoroethylene bonded cathode is selected from the group consisting of titanium, stainless steel, nickel, raney nickel, cobalt, carbon, and reticulated vitreous carbon.

55. A method as described in claim 54 in which the catalyst is selected from the group consisting of lead and gold, and the product is formate.

56. A method as described in claim 55 in which the catalyst is silicon and the product is an oxalate.

* * * * *